US005447004A

United States Patent [19]

Vrnak

[11] Patent Number: 5,447,004

[45] Date of Patent: Sep. 5, 1995

[54] TILE SETTING GRID

[76] Inventor: Miroslav Vrnak, 2180 Greenfield Dr., Fairfield, Calif. 94533

[21] Appl. No.: 224,510

[22] Filed: Apr. 7, 1994

[51] Int. Cl.[6] ..... E04C 2/42; F16S 3/00

[52] U.S. Cl. ..... 52/387; 52/664; 52/677

[58] Field of Search ..... 52/387–387, 52/389, 481.2, 482, 677, 664, 749, 744; 33/518, 527, 526, 562, DIG. 20

[56] References Cited

U.S. PATENT DOCUMENTS

| | | | |
|---|---|---|---|
| 636,200 | 10/1899 | Frink | 52/386 |
| 722,520 | 3/1903 | Lawsite | 52/386 |
| 1,836,964 | 12/1931 | Grigsby et al. | 52/387 |
| 1,932,274 | 10/1933 | Kublanow . | |
| 1,966,041 | 7/1934 | Nelson | 52/389 |
| 2,114,710 | 4/1938 | Holcomb | 52/387 |
| 2,836,055 | 5/1958 | Shuman | 52/392 |
| 2,852,932 | 9/1958 | Cable | 52/385 |
| 3,238,682 | 3/1966 | Tracy et al. | 52/389 X |
| 3,254,417 | 6/1966 | Carmichael . | |
| 4,712,309 | 12/1987 | Kingston et al. | 33/527 |
| 4,761,926 | 8/1988 | Rea et al. | 52/387 |
| 4,888,928 | 12/1989 | Rea et al. | 52/387 |

*Primary Examiner*—Carl D. Friedman
*Assistant Examiner*—Robert J. Canfield

[57] ABSTRACT

A tile setting grid including a tile setting grid which is nailed or otherwise permanently attached to a floor or wall upon which tiles are to be installed. The tile setting grid is suppliable in sheet or roll format and has openings disposed therein within which tiles are laid. A plurality of alignment fingers which engage some edges of tiles disposed therein provide an alignment reference. The tile setting grid is also manufactured having a height representing a fraction of tile thickness thereby enabling the user to cover the entire grid with cementitious grout thereby providing a finished tiled surface.

1 Claim, 4 Drawing Sheets

FIG 7
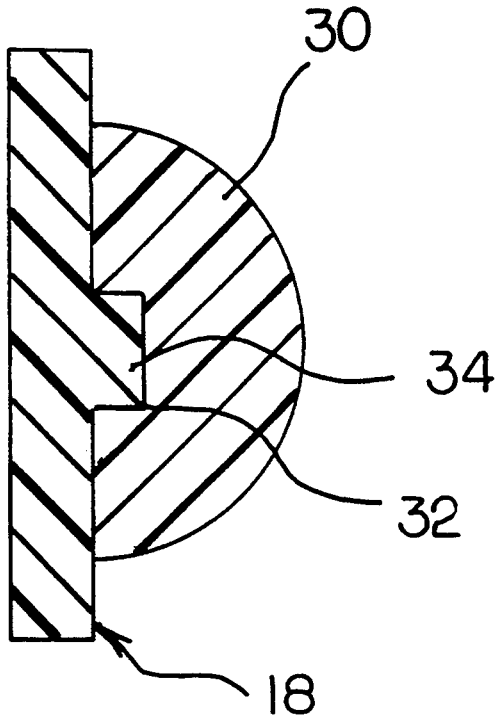
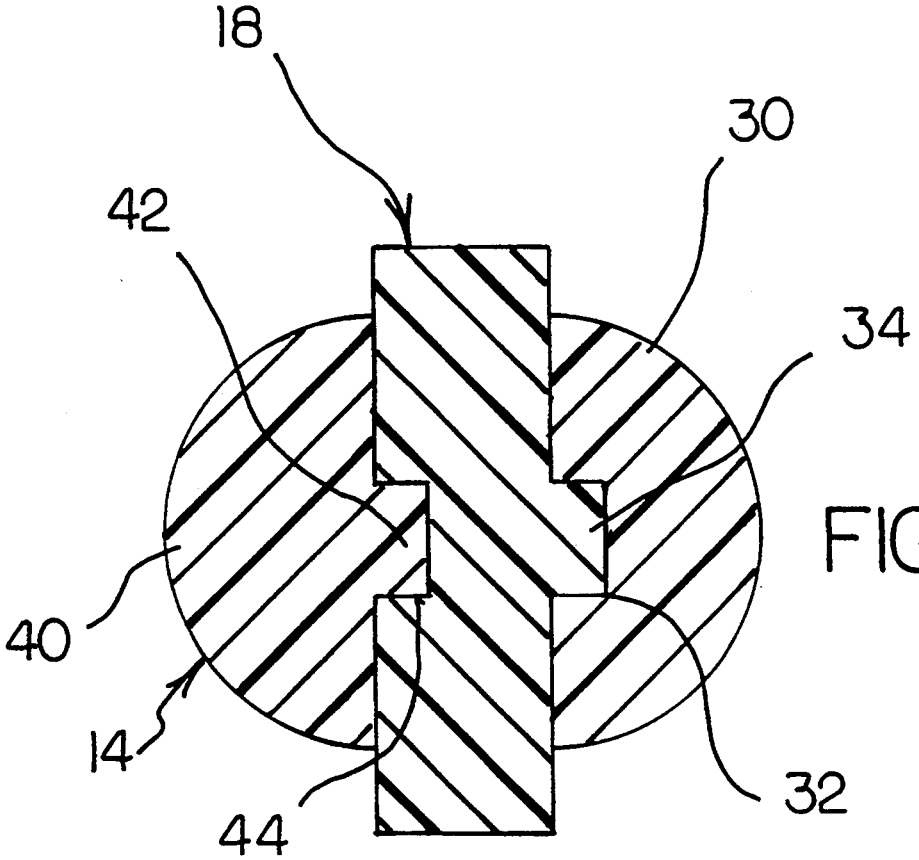
FIG 8

TILE SETTING GRID

BACKGROUND OF THE INVENTION

1. Field of the Invention

The present invention relates to tile and tile setting aides and more particularly pertains to a tile setting grid which may be employed to facilitate the laying of tiles by inexperienced and experienced personnel with substantially equivalent aesthetically pleasing results.

2. Description of the Prior Art

The use of tile setting aides and various tile design is known in the prior art. More specifically, tiles and tile setting aides heretofore devised and utilized for setting tiles are known to consist basically of familiar, expected and obvious structural configurations, notwithstanding the myriad of designs encompassed by the crowded prior art which have been developed for the fulfillment of countless objectives and requirements.

The present invention is directed to improving devices for setting tiles in a manner which is safe, secure, economical and aesthetically pleasing.

For example, U.S. Pat. No. 3,775,856 to Schmidt discloses a tile setting template 100 comprising a rack 102 having a plurality of tile receiving pockets 104 disposed in a desired laying pattern for employment in laying floor tile. See FIG. 1. Interengagement of several tile setting templates 100 enables laying tile over relatively large floor areas and handle 106 facilitates removal of template 100 after tiles are set. The Schmidt invention is removed after tiles are set and reused for another tile setting operation. The present invention provides a tile and grid wherein the grid is secured in place and becomes thereby part of the tile finished structure.

In U.S. Pat. No. 3,199,205 to Halde et al. an aligning apparatus for tile 200 is disclosed. See FIG. 2. The Halde invention comprises an L-shaped square 202 having a plurality of aligning and spacing rods 204 disposed therein for the purpose of aligning rectangular tiles during setting. The Halde invention is generally useable for laying floor tile and is removed and reused. The present invention comprises tiles and a compatible gridlike aligning aid which is usable for laying floor and wall tile. The gridlike aligning aid is fastened in place and remains a part of the tile finished structure.

In U.S. Pat. No. 3,254,417 to Carmichael, Sr. a tile setting template is described wherein a framework comprising a plurality of individual tile openings is disposed upon a floor and tiles are set therein. The Carmichael, Sr. invention is removed after tile setting and reused. The present invention comprises an expendable grid having a multiplicity of pins to align tiles emplaced therein.

In U.S. Pat. No. 4,712,309 to Kingston et al. an adjustable template for positioning tile of various sizes is disclosed for setting tile. A disadvantage in this prior art lies in a lack of a permanently affixed grid enabling alignment of the tiles emplaced therein. The present invention comprises tiles and a complementary grid wherein the grid is permanently affixed to an underlying substrate upon which the tile is intendedly disposed.

U.S. Pat. No. 3,611,579 to Reid discloses a floor tile marking gauge. The disclosure teaches an adjustable template and guide for marking and cutting a single tile to be laid parallel or perpendicular to a marginal straight edge. The disclosure makes no provision for setting a single or a plurality of tiles. Furthermore, there are no provisions for alignment of tiles. The present invention comprises a tile and grid which permit laying of tiles in alignment and does not include the cutting or marking of any tile element.

In this respect, the tile setting grid according to the present invention substantially departs from the conventional concepts and designs of the prior art, and in so doing provides an apparatus primarily developed for the purpose of accurately aligning and permitting setting of floor and wall tile.

Therefore, it can be appreciated that there exists a continuing need for a new and improved tile setting grid which can be used by inexperienced persons. In this regard, the present invention substantially fulfills this need.

As illustrated by the background art, efforts are continuously being made in an attempt to improve tile setting aides. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of tile alignment tools now present in the prior art, the present invention provides an improved tile setting grid and tile construction wherein the same can be utilized for setting and aligning tiles in floor and wall applications. As such, the general purpose of the present invention, which will be described subsequently in greater detail, is to provide a new and improved tile and tile setting aid and method which has all the advantages of the prior art tile setting grids and tiles and none of the disadvantages.

The invention is defined by the appended claims with the specific embodiment shown in the attached drawings. For the purpose of summarizing the invention, the invention may be incorporated into tiles loosely engaging a gridlike framework wherein the tiles have a plurality of spacer feet disposed on an underside and the gridlike framework has a plurality of alignment fingers which enable alignment of individual tiles disposed therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved tile setting grid which is usable by untrained persons for the purpose of laying tile.

It is therefore an additional object of the present invention to provide a new and improved tile setting grid which has all the advantages of the prior art tile setting grids and tiles and none of the disadvantages.

It is another object of the present invention to provide a new and improved tile setting grid which may be easily and efficiently manufactured and marketed.

It is a further object of the present invention to provide a new and improved tile setting grid which is of a durable and reliable construction.

An even further object of the present invention is to provide a new and improved tile setting grid which is susceptible of a low cost of manufacture with regard to both materials and labor, and which accordingly is then susceptible of low prices of sale to the consuming public, thereby making such tile setting grids and tiles economically available to the buying public.

Still yet another object of the present invention is to provide a new and improved tile setting grid which provides in the apparatuses and methods of the prior art some of the advantages thereof, while simultaneously overcoming some of the disadvantages normally associated therewith.

Still another object of the present invention is to provide a new and improved tile setting grid which employs an expendable grid member being incorporated within the finished structure.

Yet another object of the present invention is to provide a new and improved tile setting grid which is compatible with common tile adhesives and manner of attachment.

Even still another object of the present invention is to provide a new and improved tile setting grid wherein the tiles may be commonly obtained in any flooring supply establishment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a sectional view of a tile setting grid taken substantially upon the plane indicated by the section line 7—7 of FIG. 6 showing a single alignment finger.

FIG. 8 is a sectional view of a tile setting grid taken substantially upon the plane indicated by the section line 8—8 of FIG. 6 showing dual opposing alignment fingers.

DESCRIPTION OF THE PREFERRED EMBODIMENT

Figure 1:
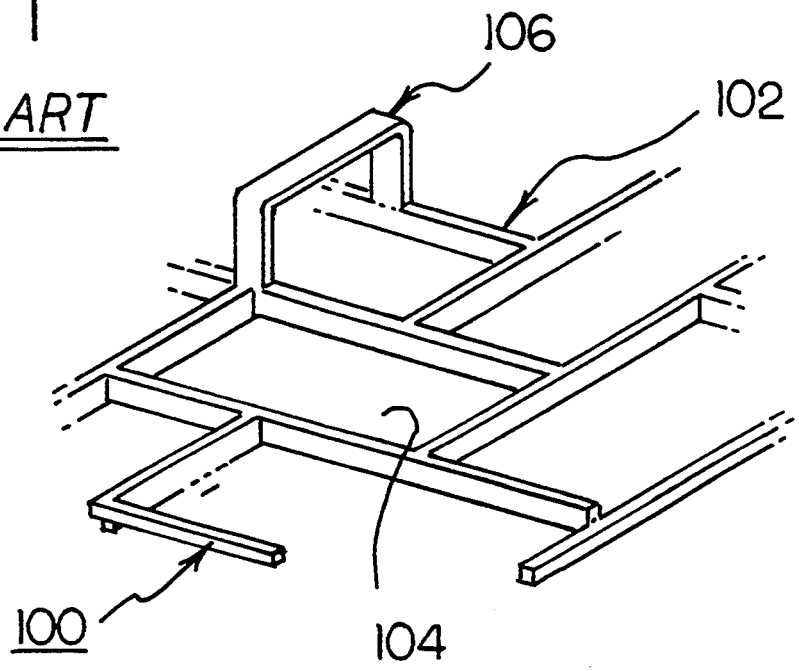
FIG 1 PRIOR ART
FIG. 1 is a perspective view of the Schmidt prior art.
Figure 2:
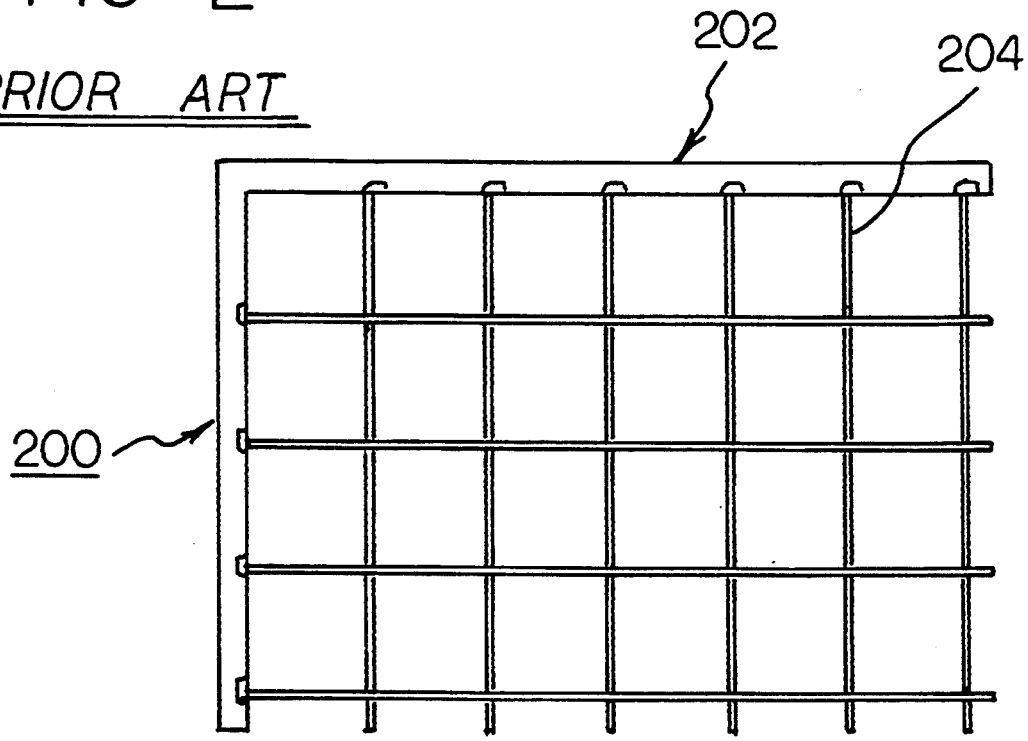
FIG 2 PRIOR ART
FIG. 2 is a plan view of the Halde et al. prior art.

With reference now to the drawings, and in particular to FIG. 1 thereof, a new and improved tile setting grid embodying the principles and concepts of the present invention and generally designated by the reference numeral 10 will be described.

Figure 3:
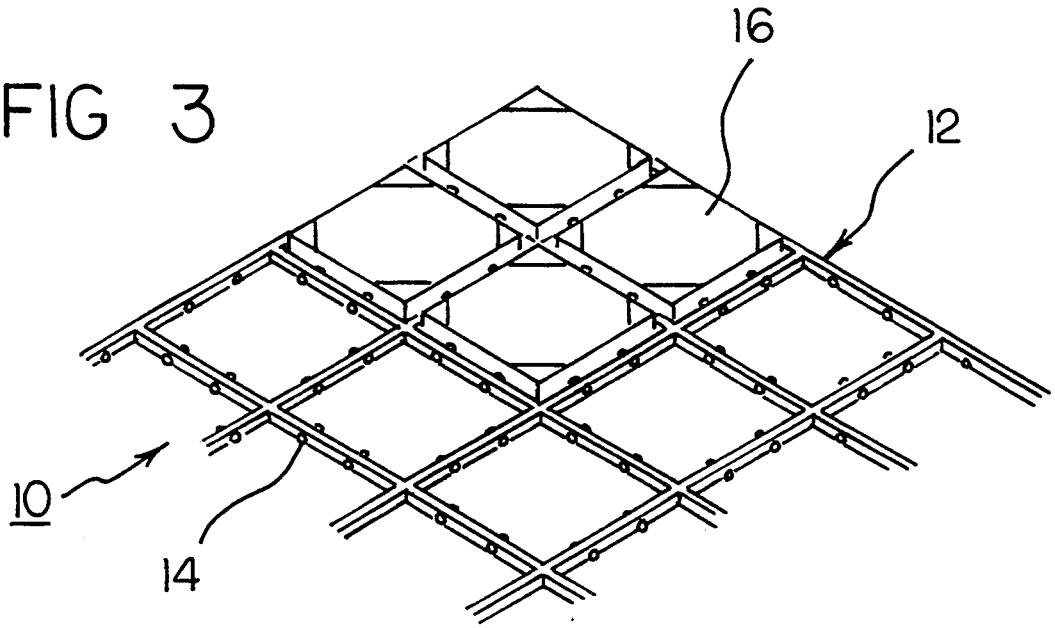
FIG. 3 is a fragmentary perspective view of the tile setting grid showing the grid and tiles laid therein.

From an overview standpoint, the tile setting grid is adapted for use with tile adhesives to neatly and accurately align and maintain alignment of tiles for the purpose of installation of wall and floor tiles. See FIG. 3. The tile setting grid 10 and tiles comprises a gridlike frame member 12 and a plurality of alignment fingers 14 which engage an edge of a tile 16 thereby aligning a tile 16 with other tiles 16 in each row or column. Gridlike frame member 12 is affixed to the floor or wall whereupon said tile 16 is to be emplaced and tiles 16 are disposed within said frame member 12 and adhesively affixed to the underlying existing construction materials.

Figure 4:
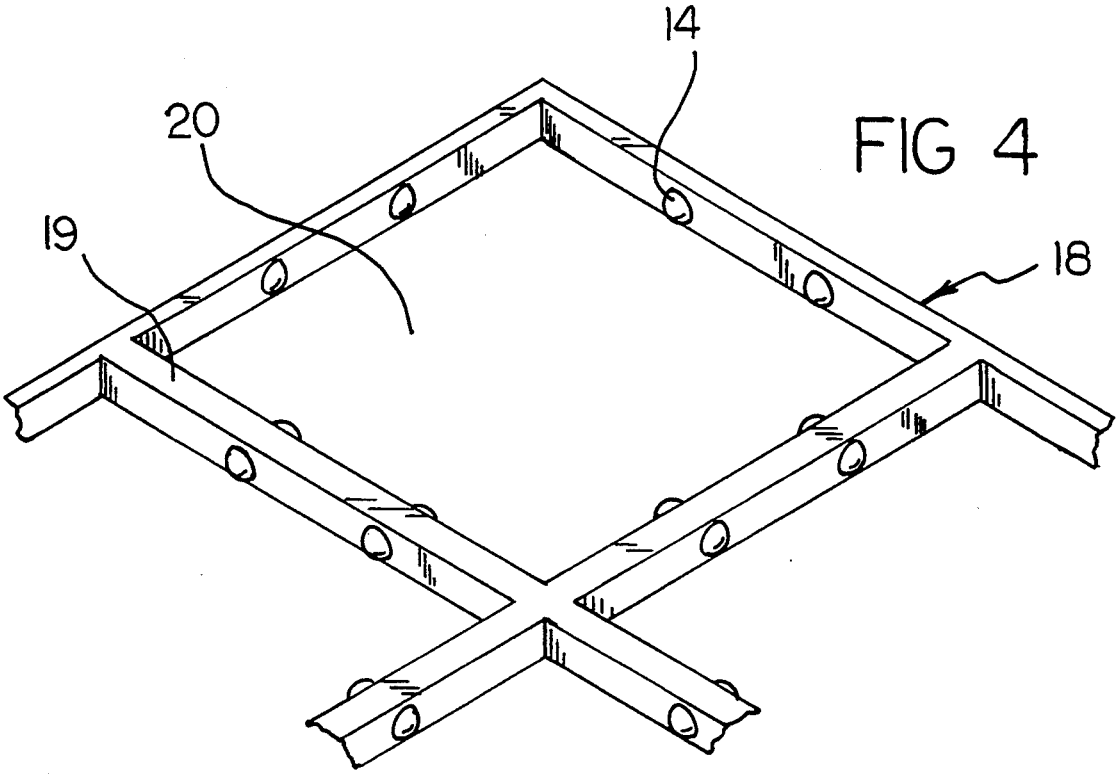
FIG. 4 is a fragmentary perspective view of the tile setting grid showing grid features.

More specifically, it will be noted that the tile setting grid 10 comprises a semi-rigid gridlike frame member 12 of plastic composition within which tiles 16 are disposed. Semi-rigid frame member 12 comprises an interconnected series of elongated bars 18 of substantially rectangular cross section wherein said interconnection may be achieved by a process of injection molding in which the entire gridlike frame member 12 may be formed in a single piece. See FIG. 4. Semi-rigid frame member 12 may be supplied in sheet form or in rolls, and furthermore fitting to the requisite shape of a floor or wall is achieved by trimming to shape using scissors, knives, or other cutting tools. The series of elongated bars 18 are cojoined to form a plurality of geometric shapes as required for specific tile applications. For example, substantially square tiles may be fit into laying space 20 outlined by a series of elongated bars 18 disposed as shown in FIG. 4, or hexagonal, round, or any other complex shaped tile may be fit into a corresponding matrix wherein the elongated bars 18 are interjoined to enable alignment of these more complex tile forms. Elongated bars 18 have a plurality of alignment fingers 14 attached thereon. Semi-rigid gridlike frame member 12 comprises thickened elongated bars 19 forming a central portion and thinned elongated bars 21 forming an edge portion. Whenever two semi-rigid gridlike frame members are laid adjacently the thinned elongated bars 21 engage thereby presenting a resultant thickness equivalent to that of thickened elongated bar 19 which preserves tile spacing and alignment.

Figure 5:
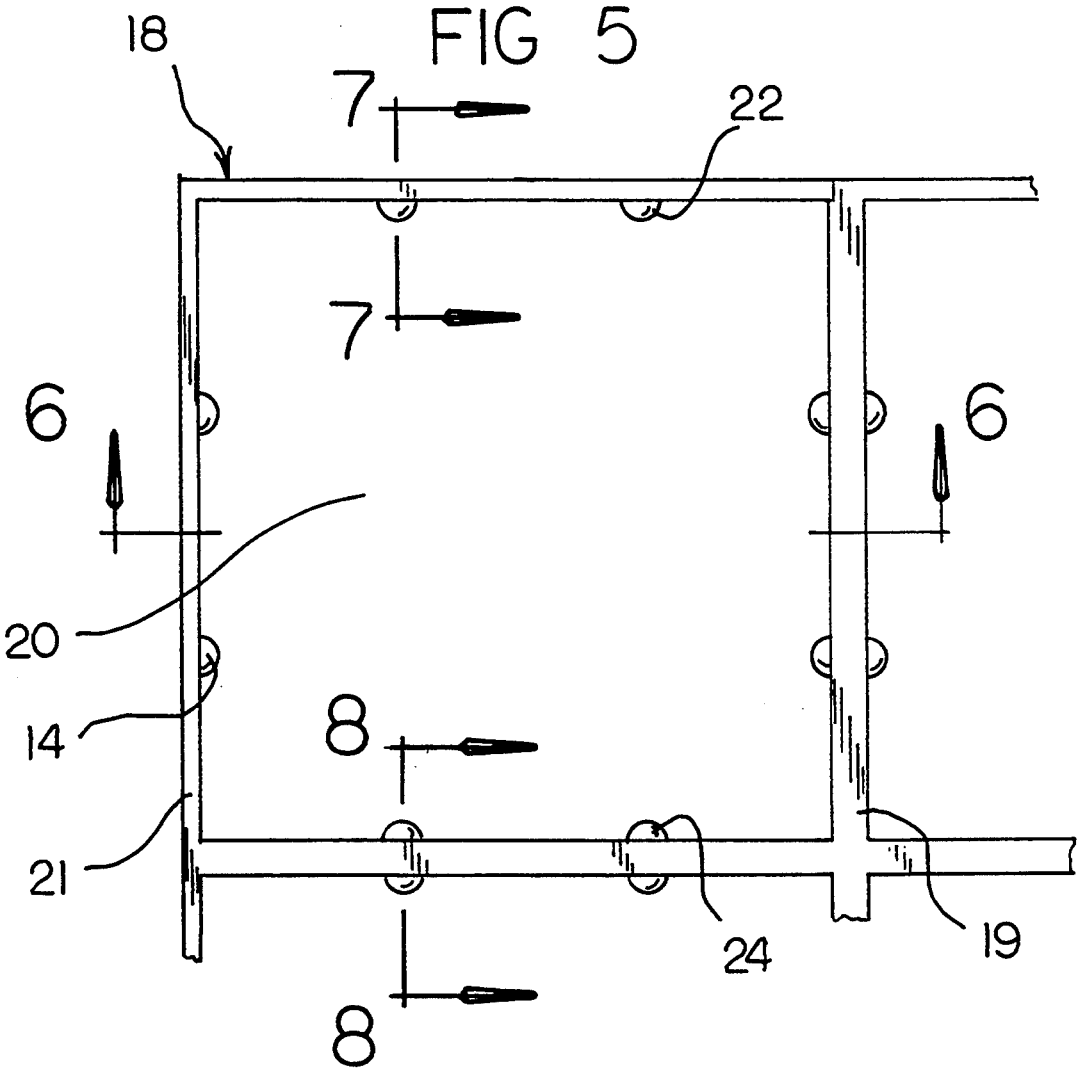
FIG. 5 is a fragmentary plan view of a tile setting grid showing a single grid element.
Figure 6:
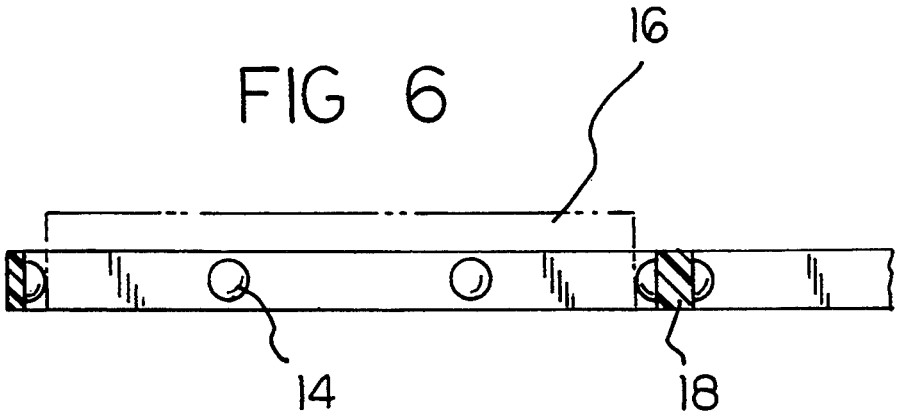
FIG. 6 is a side sectional view of the tile setting grid taken substantially upon the plane indicated by the section line 6—6 of FIG. 5.

Semi-rigid gridlike frame member 12 is nailed or otherwise attached to the existing underlaying material to which the tiles are to be attached and thereby becomes a permanent part thereof. Alignment fingers 14 are strategically disposed to provide an adequate reference for setting multiple tiles in substantial alignment thereby forming an aesthetically pleasing tile matrix. Elongated bars 18 form a complete perimeter around a given tile 16 provided that said tile 16 is not an edge tile of a type which requires cutting to fit a given contour as around pipes, baseboard, or other existing fixtures. Tile 16 engages two or more alignment fingers 14 to provide a reproducible tile spacing and a desired finished effect. The relative spacing of alignment fingers 14 permits loose engagement of the largest anticipated tile 16 of a given dimensional tile style. For example, a nine inch square tile may range in actual dimension from some minimal dimensions to nine and one eighth inches on a side. See FIG. 5.

The spacing of alignment finger 22 and opposing alignment finger 24 must exceed nine and one eighth inches by some small amount to permit insertion of tile 16 into laying space 20 without binding. In designs of semi-rigid gridlike frame member 12 for application to complex tile shapes alignment fingers 14 are similarly opposingly disposed. Elongated bars 18 are maintained at a fraction of the laid height of tile 16 to enable coverage of the entirety of semi-rigid gridlike frame member with cementitious grout materials to produce an acceptable finished surface. The expansion and contraction ability of many polymeric materials of potential use in constructing the semi-rigid gridlike frame member acting in cooperation with polymeric or rubbery cementitious grouting materials thereby providing a unique tile structure impervious to widely fluctuating temperature and humidity effects. Alignment fingers 14 are either formed as a portion of elongated bar 18 or are adhesively of snappedly applied as shown in FIG. 7 and FIG. 8.

Alignment finger 14 comprises a substantially hemispherical solid 30 having a cylindrical depression 32 centrally disposed therein for the purpose of attachment to stub 34. Stub 34 is a portion of elongated bar 18. Wherever alignment fingers are to be oppositely disposed upon a single elongated bar 18 a second hemispherical solid 40 having a stub portion 42 engages a cylindrical depression 44 disposed in opposition to stub 34 of elongated bar 18. Tiles 16 may be standard tiles as available in the general market or a specialized tile may be employed wherein said specialized tile is more accurately dimensioned to better fit in laying spaces 20 and spacing feet are disposed upon an underside of said specialized tile thereby providing substantially accurate tile height and a consequently less uneven tiled surface. And attachable tile footlike spacers may be provided for use with a non-specialized tile to provide similar tile finished height control.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by LETTERS PATENT of the United States is as follows:

1. A tile setting grid system for facilitating the setting of tiles comprising:

a semi-rigid grid formed of intersecting bars defining rectangular openings and affixable to an existing underlying construction material, the openings defining laying spaces whereinto tiles are adapted to be disposed, the bars each having both stubs and depressions on facing surfaces within the openings; and a plurality of polymeric tile alignment fingers having exterior surfaces of a hemispherical shape and having interior surfaces of a hemispherical shape and having interior surfaces, the interior surfaces including stubs and recesses coupled with respect to the depressions and stubs of the bars wherein the alignment fingers are adapted to engage a tile upon an edge thereby substantially aligning said edge with a similarly disposed edge of another tile.

* * * * *